US010655648B2

(12) United States Patent
Busani

(10) Patent No.: US 10,655,648 B2
(45) Date of Patent: May 19, 2020

(54) HYDRAULIC VALVE DEVICE WITH MULTIPLE WORKING SECTIONS WITH PUMP CONTROL SYSTEM WITH BY-PASS LINE

(71) Applicant: WALVOIL S.P.A., Reggio Emilia (IT)

(72) Inventor: Ulderico Busani, Reggio Emilia (IT)

(73) Assignee: WALVOIL S.P.A., Reggio Emilia (IT) (IT)

( * ) Notice: Subject to any disclaimer, the term of this patent is extended or adjusted under 35 U.S.C. 154(b) by 0 days.

(21) Appl. No.: 16/063,291

(22) PCT Filed: Dec. 16, 2016

(86) PCT No.: PCT/EP2016/081423
§ 371 (c)(1),
(2) Date: Jun. 17, 2018

(87) PCT Pub. No.: WO2017/103104
PCT Pub. Date: Jun. 22, 2017

(65) Prior Publication Data

US 2018/0372126 A1 Dec. 27, 2018

(30) Foreign Application Priority Data

Dec. 18, 2015 (IT) ..... B2015A9571

(51) Int. Cl.

| | |
|---|---|
| ***F15B 11/05*** | (2006.01) |
| ***F15B 11/042*** | (2006.01) |
| ***F15B 11/16*** | (2006.01) |
| *F15B 13/00* | (2006.01) |

(52) U.S. Cl.
CPC ..... *F15B 11/055* (2013.01); *F15B 11/042* (2013.01); *F15B 11/165* (2013.01); *F15B 2013/002* (2013.01); *F15B 2211/20546* (2013.01); *F15B 2211/3116* (2013.01); *F15B 2211/40507* (2013.01); *F15B 2211/40515* (2013.01); *F15B 2211/40553* (2013.01);
(Continued)

(58) Field of Classification Search
CPC ..... F15B 11/165; F15B 2013/002; F15B 2013/006; F15B 2211/3116
USPC ..... 60/422
See application file for complete search history.

(56) References Cited

U.S. PATENT DOCUMENTS 8,899,034 B2 * 12/2014 Ballweg ..... F15B 11/162 60/424
9,133,605 B2 * 9/2015 Pomeroy ..... F15B 11/162
(Continued)

*Primary Examiner* — Michael Leslie
(74) *Attorney, Agent, or Firm* — Kristina Castellano; Castellano PLLC

(57) ABSTRACT

Modular directional valve with two or more crossing elements (E1 . . . En) able, acting only on the entry side, to manage a variable displacement pump (PA) of the load sensing type.
In particular, this management allows in a single drive, unlike the conventional crossing distributors, to make the flow rate to the utility independent of the load and allows setting a maximum flow rate at the end of the stroke; in multiple drives, it ensures that the sum of the required flow rates is independent of the loads.
A compensated flow rate regulator is placed in the entry side so as to act only on the bypass line LC upstream of the first element (E1 . . . En) while a proportional choke is placed on the load line consisting of a 2-way 2-position tray.

3 Claims, 5 Drawing Sheets

(52) U.S. Cl.
CPC ..... *F15B 2211/50554* (2013.01); *F15B 2211/605* (2013.01); *F15B 2211/635* (2013.01)

(56) References Cited

U.S. PATENT DOCUMENTS

2012/0151909 A1* 6/2012 Hacker ..... F15B 11/165
60/445
2018/0372088 A1* 12/2018 Musiani ..... F15B 11/165

* cited by examiner

C
T
FS
E2
E1
FE
B2
A2
B1
A1
C2
C1
LC
5
2
3
4
8
7
30 bar
P
P1
PA
LS

HYDRAULIC VALVE DEVICE WITH MULTIPLE WORKING SECTIONS WITH PUMP CONTROL SYSTEM WITH BY-PASS LINE

CROSS REFERENCE TO RELATED APPLICATIONS

This is a U.S. National Stage application of PCT/EP2016/081423 filed on Dec. 16, 2016, which claims the benefit of Italian Patent Application ITUB2015A009571 filed Dec. 18, 2015, the contents of both of which are incorporated herein by reference.

SCOPE OF THE INVENTION

The present invention relates to the field of hydraulic valve devices with open circuit and multiple working elements or sections, wherein a suitable entry side allows managing an LS pump according to predetermined management methods.

It is noted that the protection extends to all hydraulic distributors having the claimed valve device.

PRIOR ART

More generally, open-center directional valves are conventionally combined with constant displacement pumps. Such a solution has energy limits in that also in the case of drives where only part of the available flow rate would suffice, actually the whole flow rate of the pump is brought under pressure and then the excess is laminated directly to the tank, with a useless dissipation of energy and heating of the oil.

For this reason, circuits have been devised that use variable displacement pumps of various types with suitable management systems.

A variable displacement pump used in conventional machines is the positive control pump. These are characterized in that the displacement varies as a function of a control pressure according to a regulation curve of the displacement depending on the control pressure of the type in FIG. 4.

FIG. 1 shows an example of a circuit that uses such a pump in combination with a directional valve with standard open-center elements, where in the entry side there are flow rate regulators on the LC; an example of such an application is also reported described in U.S. Pat. No. 5,546,750.

Another example of a variable displacement pump is the LS pump, in which the pump displacement varies so as to keep a constant pressure drop on a choke.

Along with these pumps, it is conventional to use LS distributors with closed-center elements and relative local compensators and a series of selectors to select the highest LS signal among the driven elements.

These distributors ensure excellent features to the circuit but they are expensive distributors and the application does not always justify the use thereof.

Open-enter hydraulic systems have been implemented for these which are able to manage an LS pump:

- An example is the flow summation which, however, is not obtained by simply changing a side but requires specific elements other than the standard crossing elements,
- Another example are the unloader sides, which allow managing an LS pump with a crossing distributor with a suitable entry side. In this case, however, unlike the new solution, in the single drive the flow rate to the utility depends on the load, meaning that with the same stroke, the flow rate to the utility varies as the load varies, if the load increases, the flow rate to the utility decreases and vice versa.

It is not even possible to set a maximum flow rate if not the maximum one of the pump which is obtained by closing the LC at the end of the stroke.

Also in the concurrent movements, the total flow rate to the utilities will depend on the loads, in addition to the fact that this will be divided between the two utilities on the basis of the reciprocal loads and as these loads vary, the division among the driven utilities varies and so does the sum of the single flow rates to the utilities.

An object of the present invention is to provide a valve device which, acting only on the entry side of a standard directional crossing valve, allows managing an LS pump according to predefined features that will be described within a simple, rational and cost-effective solution.

These and other objects are achieved with the features of the invention described in the independent claim 1. The dependent claims describe preferred and/or particularly advantageous aspects of the invention.

One aspect of the invention is to provide a valve device which includes a flow rate regulation group compensated on the bypass line upstream of the elements of the valve device and wherein said regulator includes a compensator piloted spool that imposes a constant pressure stage, and thus a constant flow rate, through a choke.

Moreover, the device includes a choke, located along the load line, so that the passage through such a choke opens proportionally to the control pressure value taken from the by-pass line downstream of the compensated flow regulator and upstream of all the elements.

Downstream of said choke, the LS signal is picked which feeds the LS pump which sends a flow rate proportional to the opening of the choke, in turn proportional to the control pressure, in turn it is proportional to the stroke of the spools, as will be apparent from the following description.

With this solution, the valve device is capable of making, in single drives, the flow rate to the utilities independent of the load and only a function of the spool stroke; in multiple drives, at least fixing the sum of the single flow rates to the utilities, although the division between the single utilities remains dependent on the loads.

This means that the flow rate to the utilities is independent of the load, meaning that given a certain stroke of the spool, the flow rate to the utilities is fixed and does not vary with the variation of the pressure to the utility.

Another aspect of the invention is to prevent a significant and unnecessary energy dissipation if the bypass line, or the crossing line, is closed completely by the drive of the spools of the elements making up the valve device.

Such a drawback is solved by the invention by inserting, before the picking point of the signal that returns to the compensator piloted spool and subsequently proportionally actuates the choke on the load line, a second choke: by closing completely the by-pass line LC and opening a relief valve, the flow rate also goes through the second choke, thereby causing a suitable reduction of the flow rate set by the compensator piloted spool, a value that will be the minimum necessary to keep the relief valve open.

BRIEF DESCRIPTION OF THE FIGURES

This and other features will be more apparent from the following description given purely by way of non-limiting example in the accompanying drawings.

DESCRIPTION OF THE INVENTION

Figure 1:
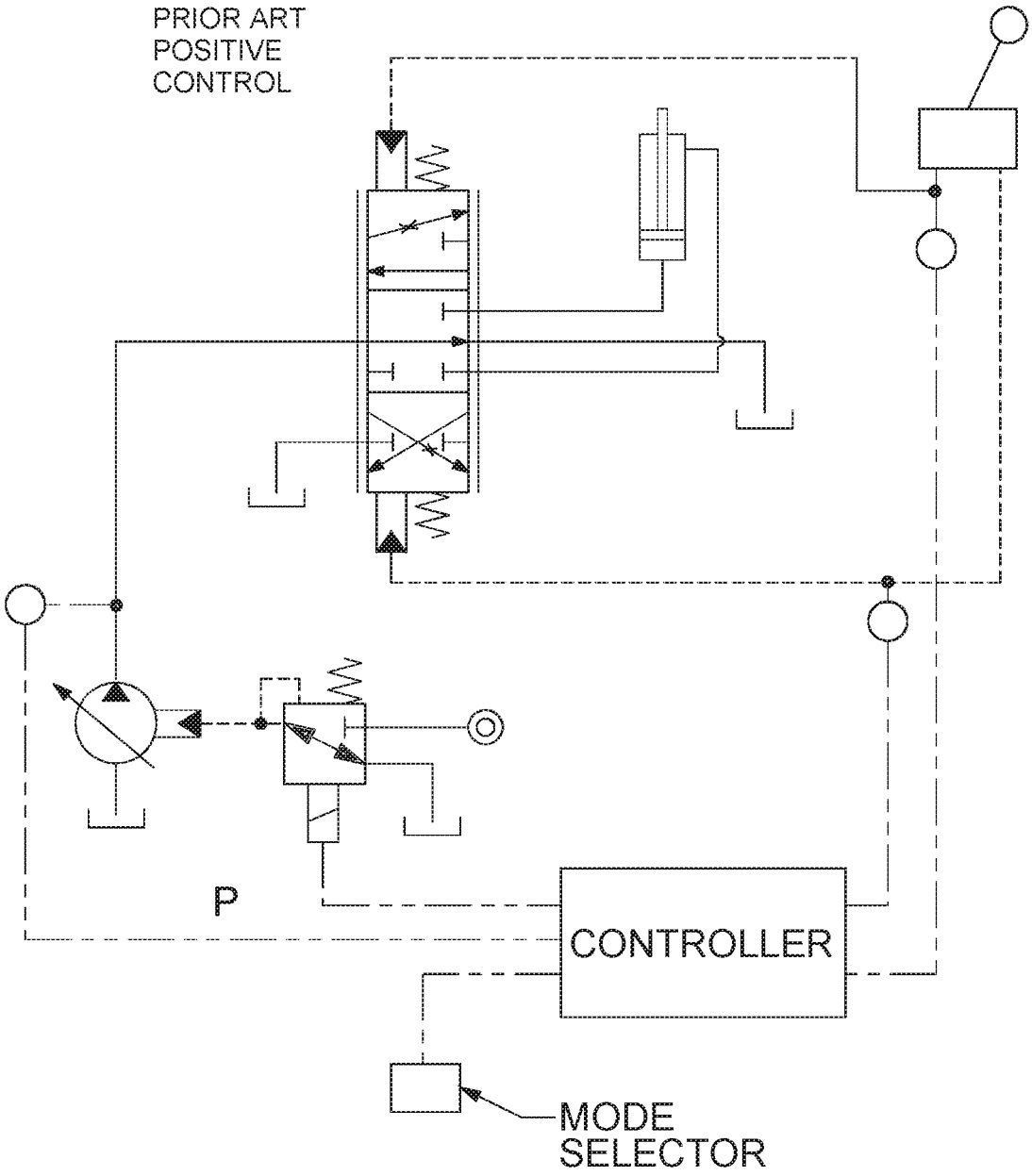
FIG. 1: illustrates a management of a pump classic example (prior art) of management with positive control.
Figure 2:
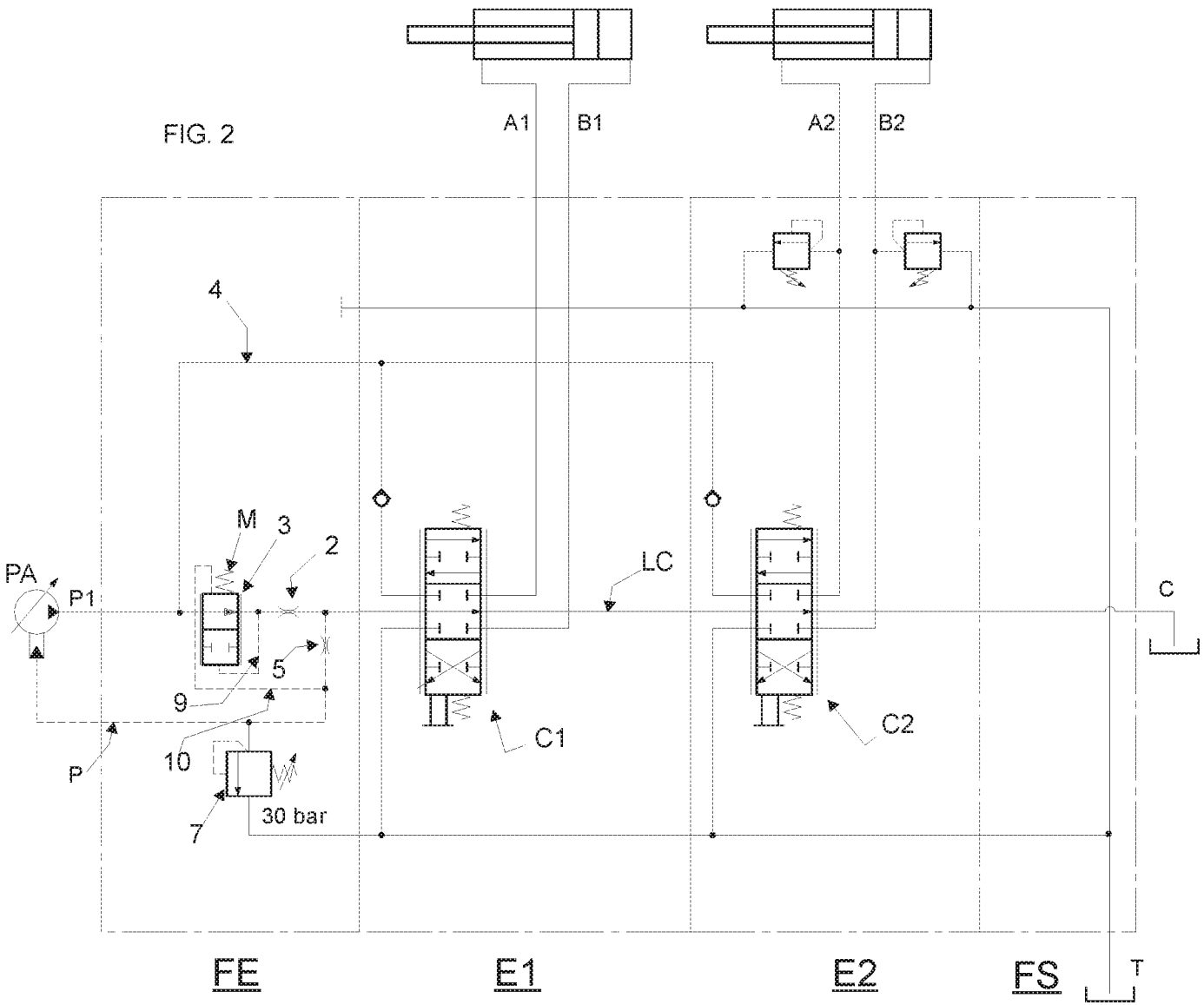
FIG. 2: illustrates a circuit diagram of the pump control device, according to the prior art, when the pump is of the "positive control" type variable displacement and with the control system.
Figure 3:
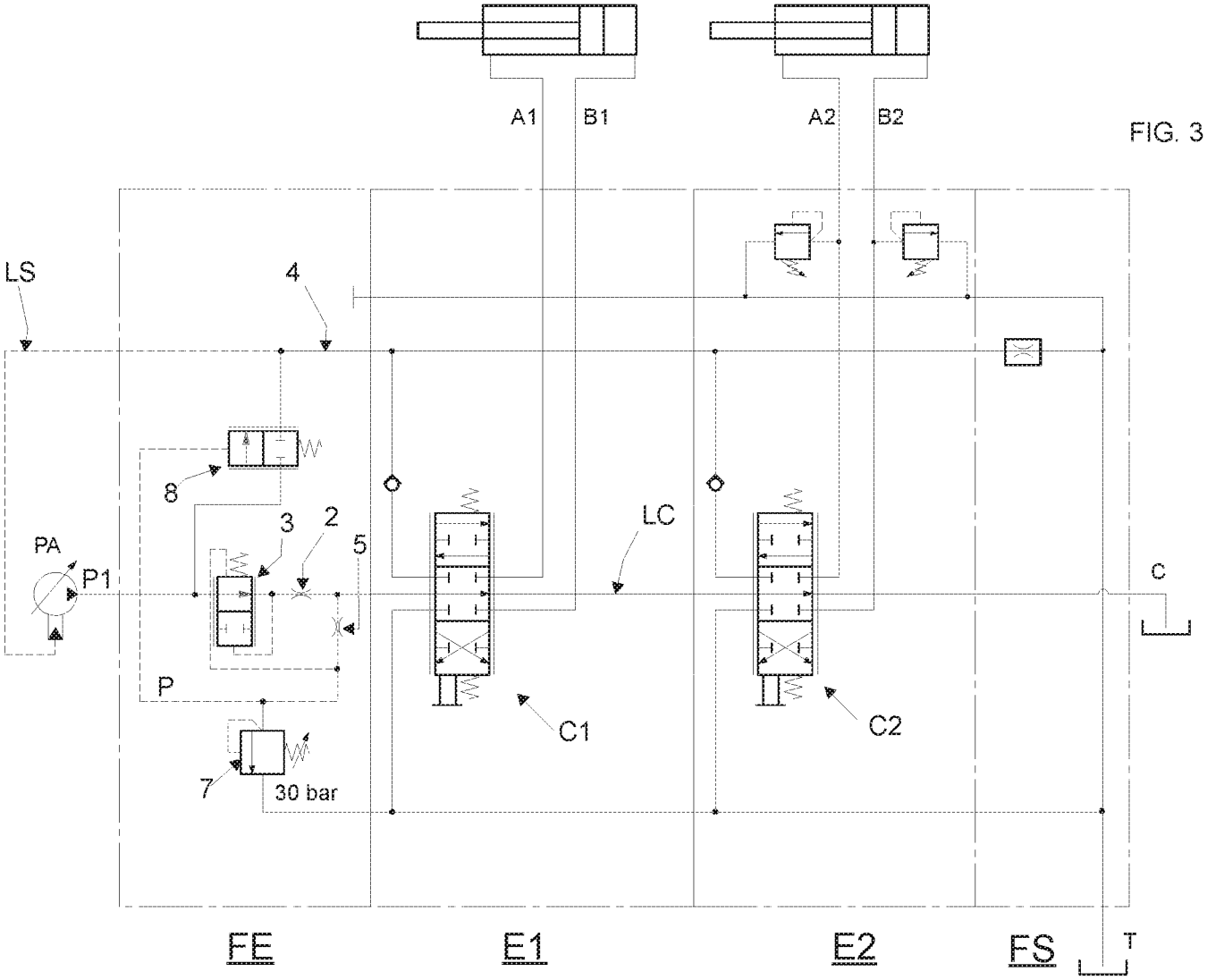
FIG. 3: illustrates the circuit diagram of the pump control device, subject of the invention, when the pump is of the type of variable displacement load sensing type.
Figure 4:
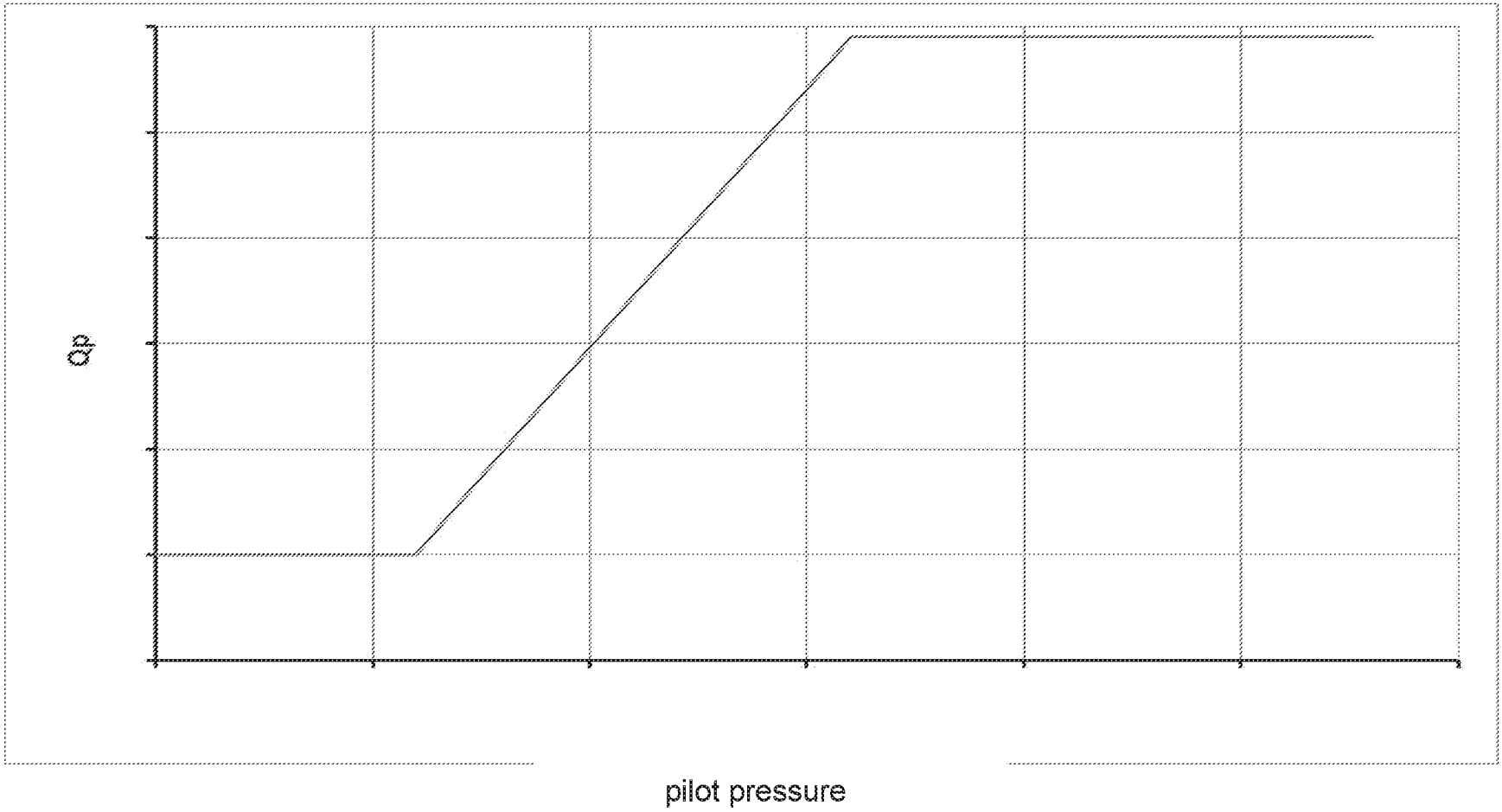
FIG. 4: shows the adjustment of the displacement curve as a function of the pilot pressure of a variable displacement pump with positive control system.
Figure 5:
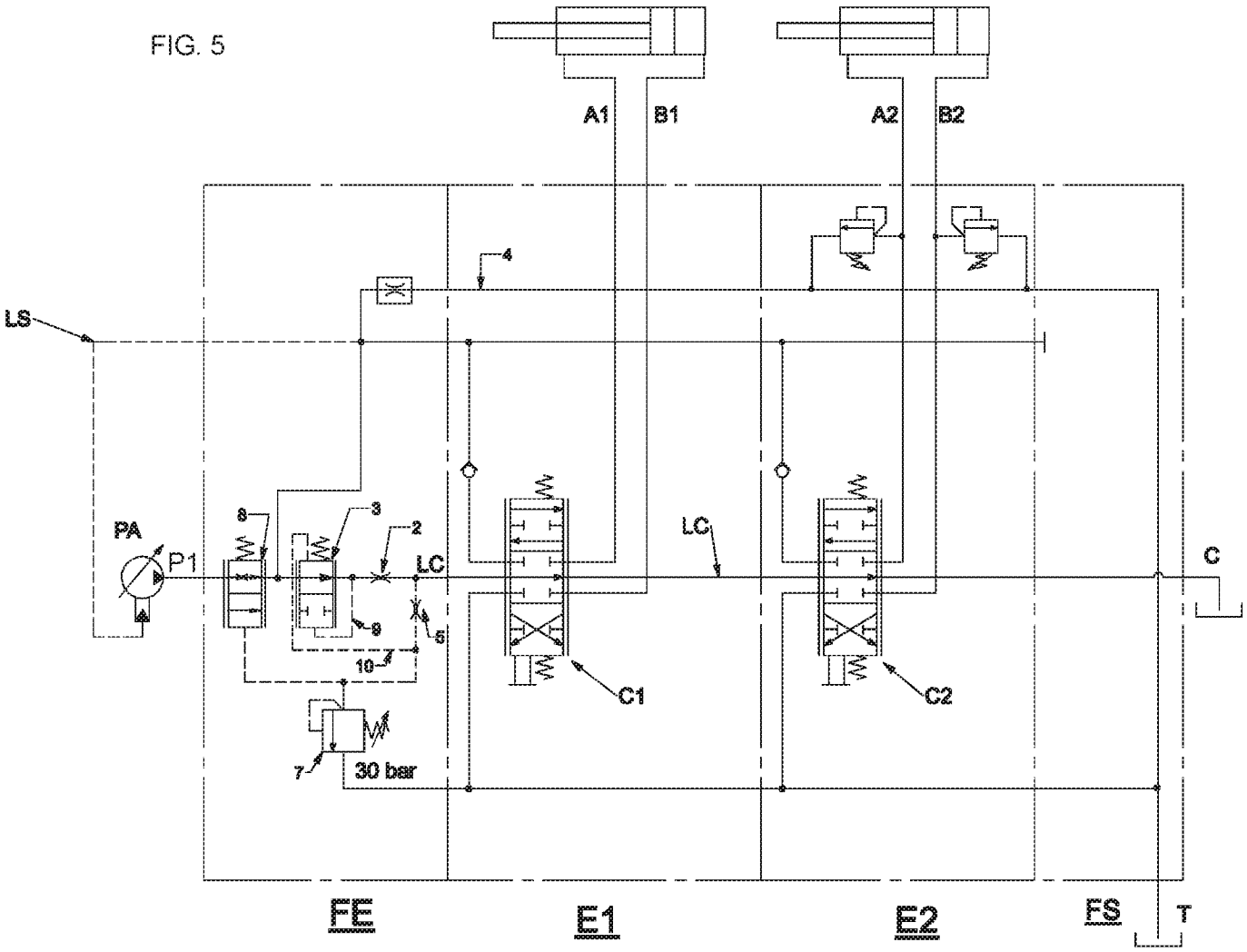
FIG. 5: illustrates in another embodiment the circuit diagram of the pump control device, subject of the invention, when the pump is of the type of variable displacement load sensing type.

With reference to FIG. 3, it shows a circuit comprising a variable displacement pump LS.

The supply is connected in P1 to the entry side FE.

One or more elements E1, E2, . . . En (in the case 2 elements E1 and E2) of the crossing type that allows connecting the PA pump and the tank to the various utilities through the uses (A1, B1, A2, B2).

A bleeding side FS keeps the flow rates from the bypass line LC separate from those coming from the return of the utilities and from the bleeds of the valves and connects them both to tank T through two separate lines.

In essence, the valve circuit of the valve device includes at least:

- A supply channel P1 connected to the LS pump, indicated with PA, which feeds the side FE and the crossing elements E1 and E2, downstream at high pressure; as mentioned, the number of elements varies in number depending on the number of utilities to connect,
- A bypass or crossing line, indicated with LC, the supply P1 to tank T; in other words, LC is a by-pass channel that connects the pump to the tank crossing all the elements in series, the passage has the maximum aperture when the spool is in central position and closes at the end of its stroke,
- Spools C1 . . . Cn of the elements E1 . . . En that intercept, among other things, said by-pass line LC; the passage in LC is open when spools C1 . . . Cn are in central position and decreases with increasing stroke up to close or achieve the maximum choke at the end of its stroke,
- A load line 4 connecting the supply P1 to the utilities with the closed passage in central position and open at the end of the stroke, also with possibility of intermediate choked positions.

Contrary to what happens in standard crossing valve distributors, where they all are connected so as to come out of a single coupling, in the present invention the line and thus the flow rate flowing into the by-pass line LC is kept separate with respect to the lines of the return flow rates of utilities and valves, which equally go to tank T but with two separate couplings, that is:

- An independent line C, connecting the bypass line LC to tank T,
- A bleed channel 6, connected to a low pressure tank T, into which the bleeds of valves and utilities flow.

From the above description, the pump flow rate in the entry side is divided into two channels:

- The bypass line LC which, with spools C1 . . . Cn in central position, crosses all the elements E1, E2 and then connects to tank T through connection C,
- The load line or channel 4 which, with spools C1 . . . Cn in central position is a closed line; the pressure relief channel 4 arrives at the utilities through the spools in parallel.

The presence of a flow rate regulator group of the two-way compensated type is also noted, placed only on the bypass line LC and in the side, before all the sections E1 . . . En.

Specifically, the flow regulator group consists of:

- A two-position compensated piloted spool 3, or with variable opening, which serves as a local compensator;
- A choked passage 2.

The strength of a spring M and the pressure of the control line P, taken downstream of chokes 2 and 5, acts on the one side on piloted spool 3, while on the other side and in closing, the pressure of line 9 taken between the piloted spool and the choked passage 2.

Spring M therefore imposes a suitable stand-by through the chokes, whose value must be lower than the stand-by set by the LS pump.

Said regulator group is calibrated, for example, to 15-20 l/min on the line LC.

Downstream of the flow rate regulator group and on the bypass line LC upstream the first element E1, the control pressure P is picked which acts by opening a choke, in this case a proportional opening tray 8, along the load line 4, the value of which will be determined by the load losses of the flow rate set by the compensated flow regulator through the bypass line LC.

Since the flow rate is constant, the load losses and thus the control pressure are proportional to the stroke of spool Cn and only to the stroke of spool C1. Since the passage through said choke 8 is proportional to the control pressure P, it is therefore proportional to the stroke of the spools.

The LS signal taken downstream of said choke 8 arrives at the LS PA pump; then, the latter will send a flow rate proportional to the opening of choke 8, in turn proportional to the control pressure, in turn proportional to the stroke of the spools.

Operation

Upon start up, the LS pump sends the minimum flow rate to generate the stand by. This corresponds to the calibration flow rate of the compensated flow regulator with lower stand-by. In fact, once such a flow rate has been reached, the regulator chokes to prevent the flow rate from exceeding the calibration, increasing the pressure in P1 up to the stand-by value of the LS pump.

Said flow rate then flows all through the compensator tray 3, then through the by-pass line LC and arrives to tank T by line C.

As said, downstream of the flow rate regulator group (piloted spool 3+choke 2) and on the bypass line LC upstream the first element E1, the control pressure P is picked which acts on the proportional choke 8, the value of which will be determined by the load losses of the flow rate through the bypass line LC.

The provision of a second choke 5 is also noted, again placed on the control line 5, in addition to a relief valve 7, in the example calibrated at 30 bar.

Therefore, the LS pump still generates the calibration flow which, along with the passages through the LC, must be such as to generate a control pressure P slightly lower than that which generates the opening of choke 8.

In the central position of the spools, the LC is open while U is closed.

The LS signal is to discharge through the bleed. The LS signal arrives at the LS pump which intervenes so that the pressure on the PA pump supply is equal to the sum of:

the load-sensing pressure taken downstream of tray 8 (in this case zero) and the pump stand-by.

Disregarding the distributed load losses, this is obtained from the LS pump by supplying the flow rate able to generate, through the flow rate regulator 3, choke 2 and the by-pass line LC that crosses all the elements in series, a load loss equal to the stand-by value of the LS pump corresponding to the constant pressure drop imposed by the pump between the supply and the load-sensing pressure.

Now the flow rate of regulator 3 to that supplied by the pump and is calculated so as to generate a pressure drop through the choke 2 higher than the stand-by of the flow regulator 3. This means that the regulator intervenes by choking the LC so as to limit the flow rate through choke 2 to that single flow rate value able to generate, through choke 2, a load loss equal to the value of the stand-by of the flow regulator 3.

Actuation of a Spool

What happens when actuating a spool individually, such as the one indicated with C1, is now described. First, the connection between the load line 4 and the corresponding utility is opened (along lines A1 or B1). At the same time, the passage through the by-pass line LC narrows, whereby load losses increase, as does the control pressure P on choke 8 taken after the compensator piloted spool 3.

Increasing the control pressure of the pump regulator leads to the opening of the passage through choke 8, thus setting the supply P1 in communication with the LS signal line. BY circuiting the P1 on the LS, the pressure in P1 increases progressively up to exceeding the load pressure on the driven utility. At that point, a flow rises through choke 8 whose value will be determined by the value of the stand-by at which the LS pump is calibrated.

The compensated flow regulator group, however, maintains a constant flow rate through the bypass line LC: therefore, the load losses, the control pressure, the opening of choke 8 and the flow rate to the utility through the load line 4 remain constant, irrespective of the load.

Moreover, since the flow rate is constant, the load losses and thus the control pressure are proportional to the stroke of spool C1 and only to the stroke of spool C1, the opening of choke 8 and thus the flow rate to the utility are a function only of the stroke.

By further actuating spool C1, the load losses through the bypass line LC, and thus the control pressure P tend to increase, thus further increasing the opening of choke 8 and the flow rate supplied by the LS pump that will flow towards the utility by the intervention of the flow regulator that maintains a constant flow rate on the bypass line LC.

It follows from the above that in the single drives, the flow rate to the utilities is independent of the load but only a function of spool C1. It follows that, in single drives, it is also possible to set a maximum flow rate to the utility.

Actuation of Multiple Spools

Assuming now that a second spool is actuated, that indicated with C2, the bypass line LC tightens further, resulting in increased load losses, increased pressure just downstream of the compensated flow regulator group, then increase in pressure P, resulting in an increase of the passage through the proportional choke 8 and thus of the flow rate supplied by the LS PA pump.

The division of the flow rate between the two utilities depends on the reciprocal loads but the total flow supplied by the LS pump is independent of the utilities.

If, at the end of the stroke of spool C2 the LC is closed, the flow rate set by the compensator flows to bleed through the relief valve 7, set at the pressure that leads the proportional choke 8 to the maximum aperture which corresponds to the maximum flow rate of the LS pump: the full flow rate at which the flow rate regulator is calibrated would directly go to bleed with a significant and useless energy dissipation.

This problem is solved by the invention by inserting, before the picking point of the signal that returns to piloted spool 3 of the compensator and then to choke 8, a second choke 5: until the relief valve 7 intervenes, no oil passes whereby the flow rate set by the compensator is determined only by the first choke 2. By closing completely the by-pass line LC and opening the relief valve 7, the flow rate also goes through the second choke 5, thereby causing a suitable reduction of the flow rate set by the compensator piloted spool 3, a value that will be the minimum necessary to keep the relief valve open.

In summary, the valve device comprises, on the bypass line LC only and upstream of the first element E1, a flow rate regulator group comprising at least one compensator piloted spool 3 and a choke 2; a control signal P connected to said flow rate regulator and to the proportional choke 8, whose passage increases as the control pressure increases; said control signal P being picked downstream of the compensator piloted spool 3 and after said choke 2.

The variable displacement pump LS is managed by the LS signal, where now, however, the LS signal is no longer taken downstream of the fixed choke 8 but of tray 2, which generates a variable choke with the stroke.

Then, the LS pump imposes a constant P through tray 8 and thus a flow rate which only depends on the stroke of tray 8 and which is constant at the same stroke.

Choke 2 is instead managed by the flow regulator 3 which imposes a constant • P through choke 2, and thus a constant flow rate through choke 2.

Finally, it is noted that "load line" means the line connecting the pump supply to utilities A1, B1, A2, B2 . . . through spools C1, C2, . . . which in central position isolate the load line 4 from the utilities. In the subject patent, tray 8 is placed on this line as a function of choke proportional to control P.

The spools are C1, C2, . . . which in central position:

Keep the connection between the pump supply and the tank open through the bypass line LC.

Keep the passage between the load line 4 and the utilities A1, B1 closed.

By actuating the spool:

The by-pass line LC chokes up to close

The connection between the load line 4 opens, thus increasing the passage up to stroke end.

Component 3 is substantially a piloted spool that keeps • P constant through the fixed choke 2.

The invention claimed is:

1. A modular directional valve device, with one or more elements and for the management of a load-sensing variable displacement pump, each element including spools configured to control the drive to relative utilities, the modular directional valve device being arranged for a connection to the load-sensing variable displacement pump a supply line, which is divided into at least two channels, of which:

a. a bypass line which, with the spools in central position, crosses all the elements and then connects to a tank through an independent connection, b. a load line which, with spools in central position, is a closed line, said modular directional valve device comprising, on the bypass line only and upstream of a first element of the one or more elements, a flow rate regulator group comprising at least one piloted spool and a choke, a control signal being connected to said flow rate regulator group acting on a proportional variable choke along said supply line or along said load line and wherein a load-sensing signal (LS) along said load line downstream of said choke reaches the load-sensing variable displacement pump.

2. The modular directional valve device according to claim 1, comprising a second choke along the control signal and a relief valve on the same control signal downstream of said second choke, the relief valve being calibrated at a pressure that brings the second choke to a maximum aperture which corresponds to a maximum displacement of the load-sensing variable displacement pump.

3. The modular directional valve device according to claim 1, wherein said flow rate regulator group is comprised in an entry side of the device.

* * * * *